US010335936B2

(12) United States Patent
Lai

(10) Patent No.: US 10,335,936 B2
(45) Date of Patent: Jul. 2, 2019

(54) FIRING CONTROL DEVICE FOR A PNEUMATIC TOOL

(71) Applicant: Basso Industry Corp., Taichung (TW)

(72) Inventor: Chun-Chi Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 302 days.

(21) Appl. No.: 15/459,050

(22) Filed: Mar. 15, 2017

(65) Prior Publication Data

US 2017/0266795 A1 Sep. 21, 2017

(30) Foreign Application Priority Data

Mar. 18, 2016 (TW) ..... 105108409 A

(51) Int. Cl.
*B25C 1/04* (2006.01)
*B25C 1/00* (2006.01)

(52) U.S. Cl.
CPC ..... *B25C 1/008* (2013.01); *B25C 1/04* (2013.01); *B25C 1/041* (2013.01); *B25C 1/042* (2013.01); *B25C 1/043* (2013.01)

(58) Field of Classification Search
CPC .. B25C 1/00; B25C 1/008; B25C 1/04; B25C 1/041; B25C 1/042; B25C 1/043; B25C 1/047; B25C 5/00; B25C 5/02
USPC ..... 227/8, 120, 130, 136; 91/308, 356, 461; 173/169
See application file for complete search history.

(56) References Cited

U.S. PATENT DOCUMENTS 3,498,517 A 3/1970 Novak
3,563,438 A * 2/1971 Doyle ..... B25C 1/003 227/130
3,583,496 A * 6/1971 Fehrs ..... B25C 1/043 173/15
3,685,396 A * 8/1972 Obergfell ..... B25C 1/041 91/356
4,165,676 A * 8/1979 Siegmann ..... B25C 1/041 137/596.2
4,384,668 A * 5/1983 Tutomu ..... B25C 1/041 173/169
4,550,643 A * 11/1985 Schwartzenberger .. B25C 1/043 227/8
4,784,308 A * 11/1988 Novak ..... B25C 1/003 227/120
4,915,013 A * 4/1990 Moraht ..... B25C 1/043 227/130

(Continued)

OTHER PUBLICATIONS

The Search Report issued to European counterpart application No. 17161407.6 by the EPO dated Apr. 17, 2018.

*Primary Examiner* — Scott A Smith
(74) *Attorney, Agent, or Firm* — Trop, Pruner & Hu, P.C.

(57) ABSTRACT

A firing control device for use in a pneumatic tool includes a flow path unit, a conditioning valve and a switch valve. The flow path unit is connected to a main. chamber and an operating chamber of the pneumatic tool. The conditioning valve blocks fluid communication between the main chamber and the operating chamber via the flow path unit. When the switch valve is activated, the pressure in the casing is permitted to move the conditioning valve. The conditioning valve is moved to permit the fluid communication between the main chamber and the operating chamber via the flow path unit when the switch valve is continuously activated by a predetermined time period.

16 Claims, 14 Drawing Sheets

(56) References Cited

U.S. PATENT DOCUMENTS 5,370,037 A * 12/1994 Bauer ..... B25C 1/042 91/236
5,485,946 A * 1/1996 Jankel ..... B25C 1/042 227/130
5,522,532 A 6/1996 Chen
5,669,542 A * 9/1997 White ..... B25C 1/042 227/130
5,671,880 A * 9/1997 Ronconi ..... B25C 1/042 227/130
5,829,660 A * 11/1998 White ..... B25C 1/041 227/8
5,896,933 A * 4/1999 White ..... B25C 1/043 227/130
6,371,348 B1 * 4/2002 Canlas ..... B25C 1/008 123/46 SC
7,308,995 B2 * 12/2007 Uchiyama ..... B25C 1/043 227/130
7,556,183 B1 * 7/2009 Liang ..... B25C 1/008 227/112
7,931,180 B2 * 4/2011 Lai ..... B25C 1/047 227/130
9,061,408 B2 * 6/2015 Ishizawa ..... B25C 1/047
9,709,187 B2 * 7/2017 Liu ..... F16K 31/602
9,782,879 B2 * 10/2017 Bauer ..... B25C 1/04
2001/0009260 A1 * 7/2001 Ishizawa ..... B25C 1/043 227/8
2007/0075113 A1 * 4/2007 Tillinghast ..... B25C 1/008 227/130
2007/0251972 A1 * 11/2007 Lee ..... B25C 1/043 227/130
2010/0252608 A1 * 10/2010 Lai ..... B25C 1/047 227/8
2014/0231485 A1 8/2014 Bauer

* cited by examiner

FIRING CONTROL DEVICE FOR A PNEUMATIC TOOL

CROSS-REFERENCE TO RELATED APPLICATION

This application claims priority of Taiwanese Patent Application No. 105108409, filed on Mar. 18, 2016.

FIELD

The disclosure relates to a firing control device, and more particularly to a firing control device for a pneumatic tool.

BACKGROUND

A conventional pneumatic tool disclosed in U.S. Patent Application Publication 20140231485 includes a trigger, a force transmission element, a first control valve, a second control valve, a control piston that is associated with the first control valve, and a locking piston that is associated with the second control valve and that is movable within a housing cap. The second control valve is activated to drive movement of the locking piston upon depression of the trigger. The first control valve is activated to drive movement of the control piston when both of the trigger and the force transmission element are depressed. A fastener can be fired by the conventional pneumatic tool by continuously depressing the trigger and subsequently depressing the force transmission element. After the trigger is continuously depressed by a predetermined time period, the locking piston is moved onto a moving path of the control piston upon the activation of the second control valve, so as to prevent the movement of the control piston. As such, when a time delay between the depression of the trigger and the depression of the force transmission element is less than the predetermined time period, the first control valve is activated to drive movement of the control piston upon the depression of the force transmission element, so as to fire the fastener. When a time delay between the depression of the trigger and the depression of the force transmission element is greater than the predetermined time period, the control piston cannot be moved for firing the fastener upon the activation of the first control valve by virtue of the depression of the force transmission element since the control piston is locked by the locking piston.

However, since the locking piston serves as a latch for preventing the movement of the control piston, the locking piston and the control piston may easily be worn, and the air-tightness between the locking piston and the housing cap may be affected by the control piston.

SUMMARY

Therefore, an object of the disclosure is to provide a firing control device that can alleviate at least one of the drawbacks of the prior art According to the disclosure, the firing control device is for use in a pneumatic tool. The pneumatic tool includes a casing that defines a main chamber and an operating chamber therein, a safety member that is movably mounted to the casing, a trigger assembly that is pivotally mounted to the casing, and a valve rod that is movable relative to the casing. When both of the safety member and the trigger assembly are depressed, the valve rod is activated for preventing fluid communication between the main chamber and the operating chamber and for releasing the pressure in the operating chamber so as to fire a fastener. The firing control device includes a flow path unit, a conditioning valve assembly and a switch valve assembly. The flow path unit is connected to the main chamber, the operating chamber and the outside of the pneumatic tool. The conditioning valve assembly includes a conditioning valve that is movably disposed in the flow path unit and that removably blocks fluid communication between the main chamber and the operating chamber via the flow path unit. The switch valve assembly includes a switch valve that is movably disposed in the flow path unit. The switch valve is activated upon the depression of the trigger assembly to prevent fluid communication between the flow path unit and the outside, and to permit the pressure in the casing to move the conditioning valve. The conditioning valve is moved to permit the fluid communication between the main chamber and the operating chamber via the flow path unit when the switch valve is continuously activated by a predetermined time period, so that the fluid communication between the main chamber and the operating chamber is maintained upon the activation of the valve rod, and the fastener is prevented from being fired.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
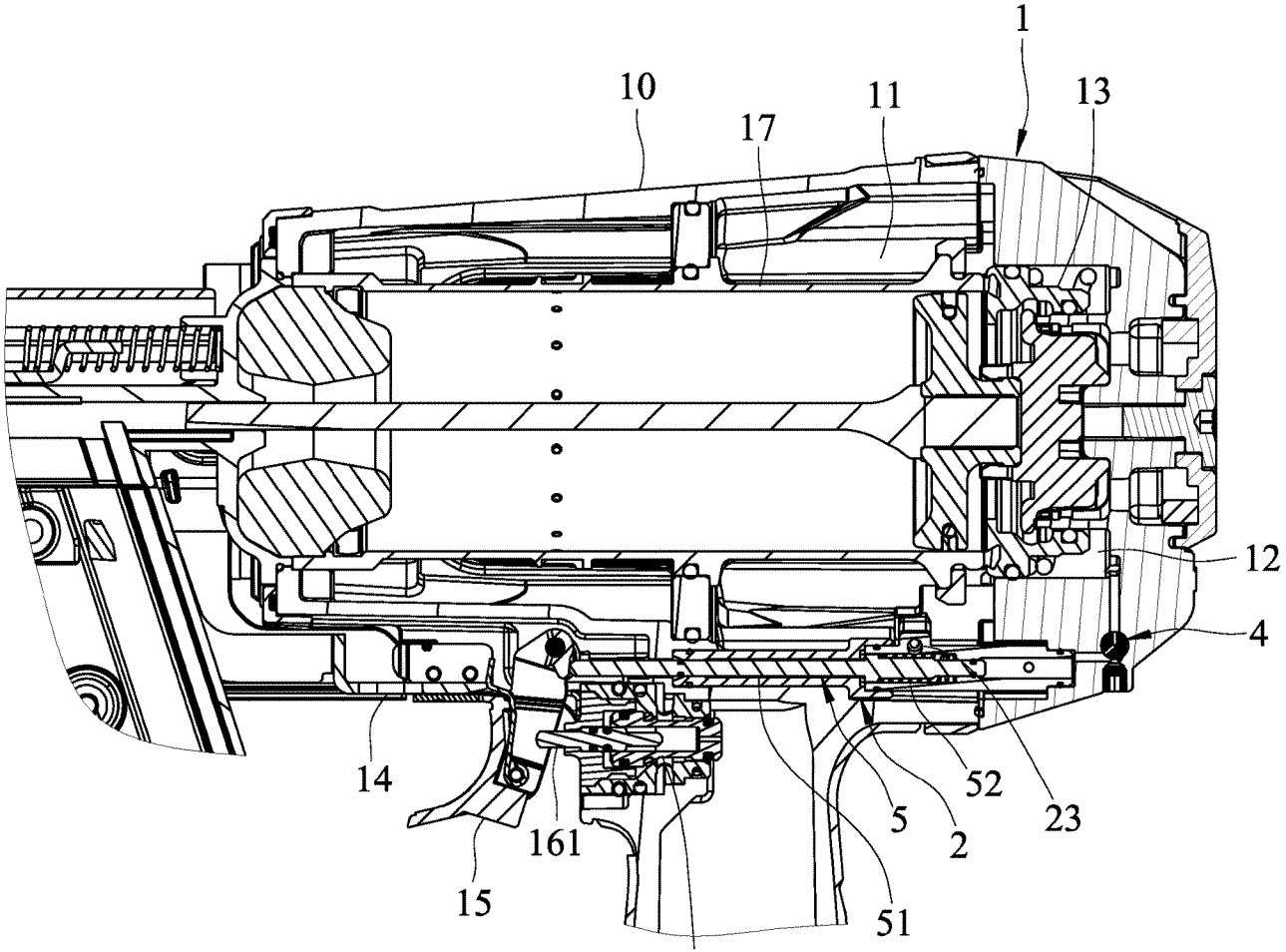
FIG. 1 is a fragmentary sectional view illustrating a first embodiment of the firing control device according to the disclosure used in a pneumatic tool.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
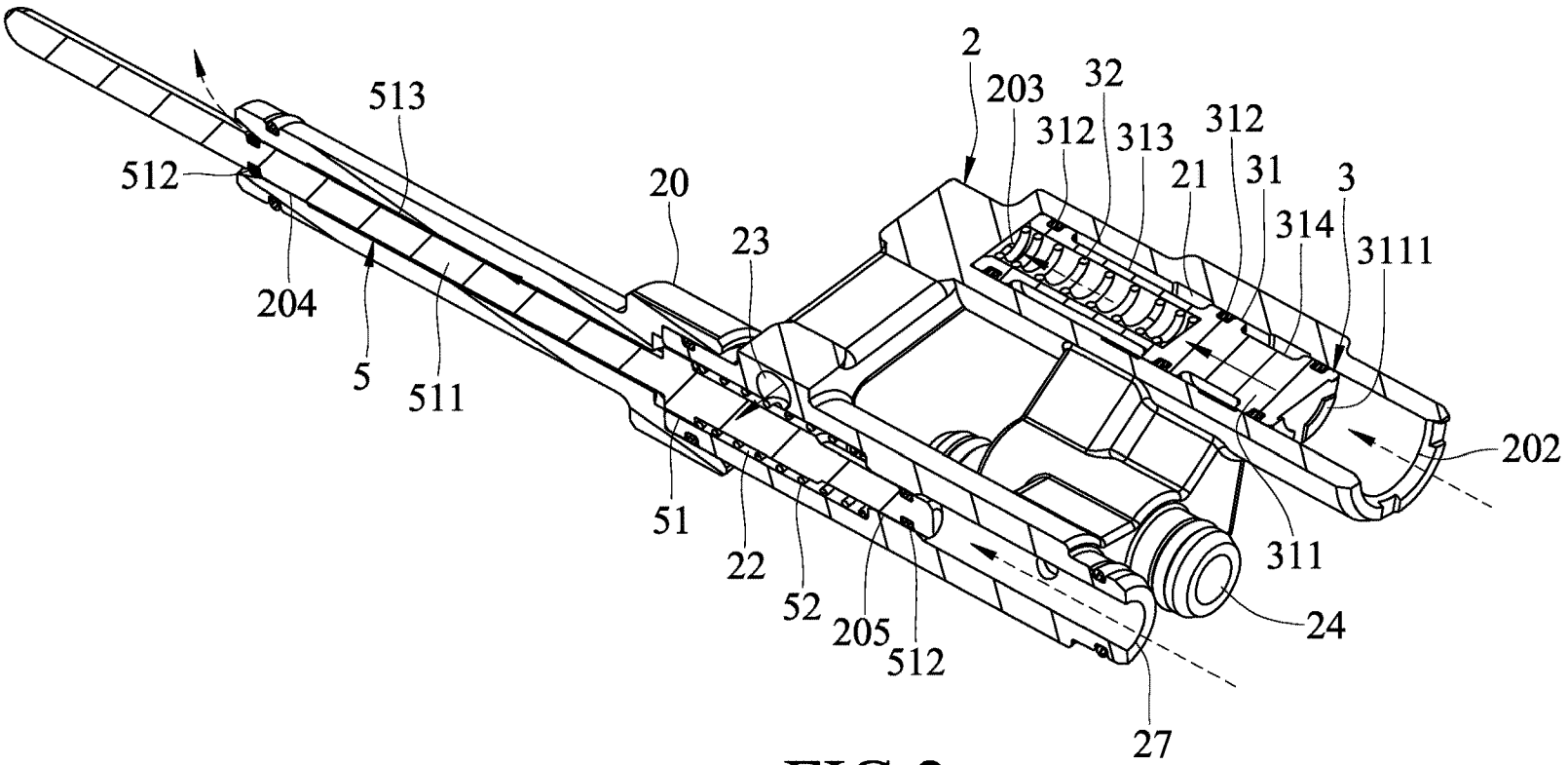
FIG. 2 is a schematic cutaway perspective view illustrating a conditioning valve of the first embodiment at an initial position and a switch valve of the first embodiment at a non-activated position.
Figure 3:
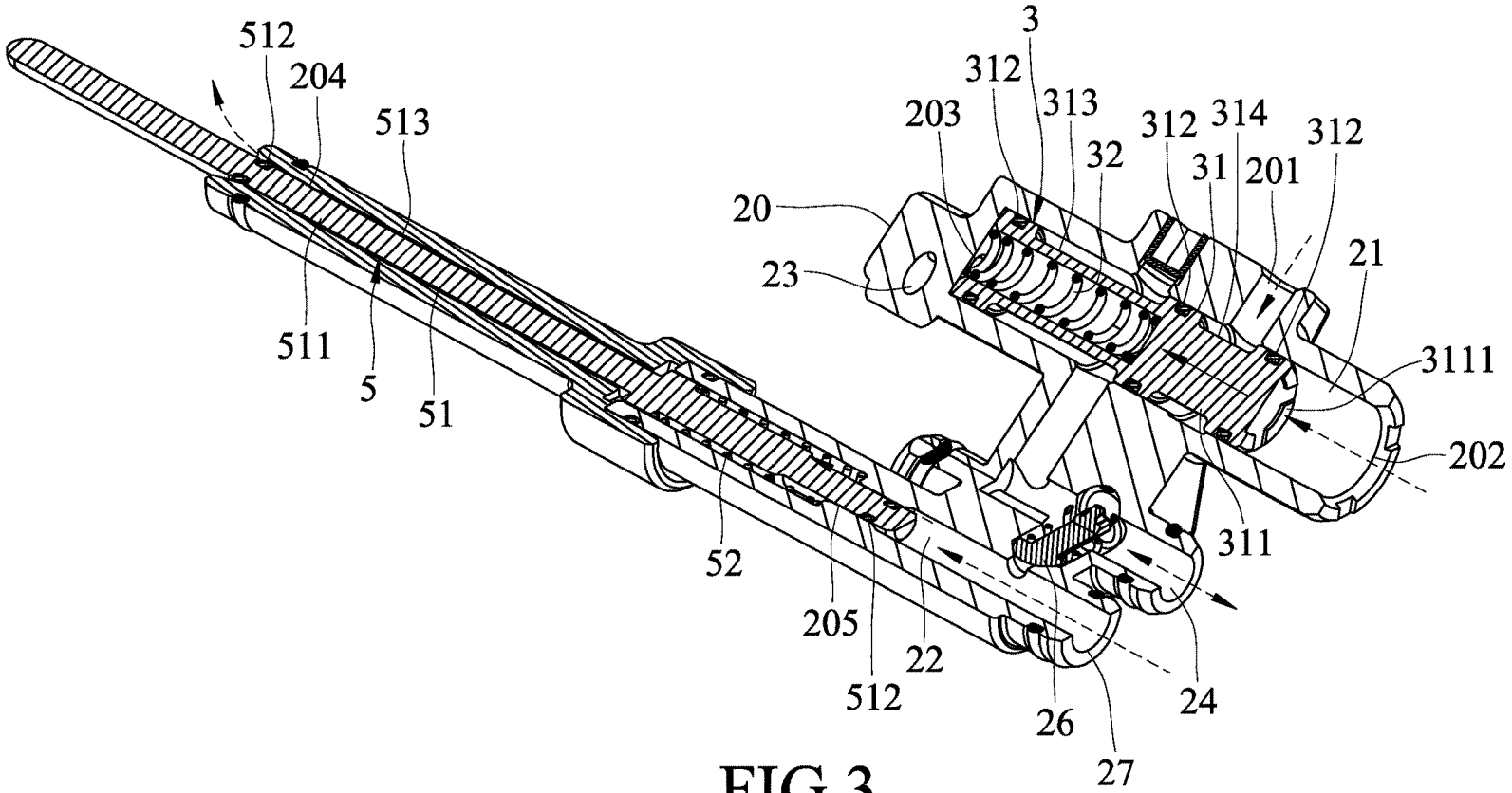
FIG. 3 is another schematic cutaway perspective view illustrating the conditioning valve at the initial position and the switch valve at the non-activated position.

Referring to FIGS. 1 to 3, the first embodiment of the firing control device according to the disclosure is for use in a pneumatic tool 1. The pneumatic tool 1 includes a casino 10 that defines a main chamber 11 and an operating chamber 12 therein, a valve head 13 that is movable within the casing 10, a safety member 14 that is movably mounted to the casing 10, a trigger assembly 15 that is pivotally mounted to the casing 10, an actuating valve 16, and a cylinder body 17. The main chamber 11 is continuously supplied with compressed air by an air source. The valve head 13 is disposed between the main chamber 11 and the operating chamber 12, and removably seals the cylinder body 17. The actuating valve 16 includes a valve rod 161 that is movable relative to the casing 10 between an activated position (see FIG. 4) where both of the trigger assembly 15 and the safety member 14 are depressed, and a non-activated position (see FIG. 1) where the trigger assembly 15 and the safety member 14 are not simultaneously depressed. When the valve rod 161 is at the non-activated position, the operating chamber 12 is permitted to communicate fluidly with the main chamber 11 via an inner flow path and is prevented from communicating fluidly with the outside, so that the pressure in the operating chamber 12 is the same as that in the main chamber 11, and the valve head 13 is therefore maintained to seal the cylinder body 17. When the valve rod 161 is at the activated position, the operating chamber 12 is prevented from communicating fluidly with the main chamber 11 via the inner flow path and is permitted to communicate fluidly with the outside, so that the pressure in the operating chamber 12 is much smaller than that in the main chamber 11, and the valve head 13 is therefore moved to open the cylinder body 17 due to the pressure difference between the main chamber 11 and the operating chamber 12, so as to permit the compressed air in the main chamber 11 to flow into the cylinder body 17 for firing a fastener. As such, the fastener can be fired by the pneumatic tool 1 by continuously depressing the trigger assembly 15 and subsequently depressing the safety member 14 to activate the valve rod 161.

The first embodiment of the firing control device includes a flow path unit 2, a conditioning valve assembly 3, a throttle valve unit 4 and a switch valve assembly 5.

The flow path unit 2 includes a casing seat 20, a first passage 21 that is formed in the casing seat 20 and that is in fluid communication with the main chamber 11, a second passage 22 that is parallel to the first passage 21, a connecting passage 23 that is in fluid communication with the first and second passages 21, 22, an inflation passage 24 that is in fluid communication with the first passage 21 and the operating chamber 12, and a one-way valve unit 26.

The casing seat 20 has a lateral opening 201 that communicates fluidly the main chamber 11 with an intermediate section of the first passage 21, a first end opening 202 that communicates fluidly the main chamber 11 with a first lengthwise end section of the first passage 21, a communicating hole 203 that communicates fluidly the connecting passage 23 with a second lengthwise end section of the first passage 21 that is opposite to the first lengthwise end section of the first passage 21, and a second end opening 27 that communicates fluidly a first lengthwise end section of the second passage 22 with either one of the main chamber 11 and the operating chamber 12. The second passage 22 has first and second shrunk sections 204, 205 that are spaced apart from each other in the lengthwise direction of the second passage 22. The connecting passage 23 is in fluid communication with an intermediate section of the second passage 22 that is located between the first and second shrunk sections 204, 205. The first shrunk section 204 is located between the intermediate section of the second passage 22 and a second lengthwise end section of the second passage 22 that is distal from the second end opening 27 and that communicates fluidly with the outside. The second shrunk section 205 is located between the intermediate section of the second passage 22 and the second end opening 27. The inflation passage 24 is in fluid communication with the intermediate section of the first passage 21. In the first embodiment, the one-way valve unit 26 is capable of fluidly communicating the first lengthwise end section of the second passage 22 with the inflation passage 24, and permits the air to flow from the second passage 22 into the inflation passage 24 only.

The conditioning valve assembly 3 includes a conditioning valve 31 that is movable along the first passage 21, and a conditioning resilient member 32.

The conditioning valve 31 includes a valve body 311, and three conditioning sealing rings 312 that are sleeved on the valve body 311 and that are spaced apart from each other. The conditioning sealing rings 312 are in air-tight contact with an inner surrounding surface of the casing seat 20 that defines the first passage 21, and cooperatively define first and second annular gaps 313, 314 that are not in fluid communication with each other (each of the first and second annular gaps 313, 314 is defined between two adjacent ones of the conditioning sealing rings 312). The valve body 311 has an end surface 3111 that faces toward the first end opening 202. The conditioning valve 31 is movable relative to the casing seat 20 between an initial position (see FIGS. 2 and 3) and an ultimate position (see FIGS. 5 and 6).

When the conditioning valve 31 is at the ultimate position, the main chamber 11 is in fluid communication with the first annular gap 313 via the lateral opening 201, and the operating chamber is in fluid communication with the first annular gap 313 via the inflation passage 24, so that the main chamber 11 and the operating chamber 12 are in fluid communication with each other via the first passage 21 and the inflation passage 24.

When the conditioning valve 31 leaves the ultimate position, the main chamber 11 is in fluid communication with the second annular gap 314 via the lateral opening 201, and the operating chamber 12 is in fluid communication with the first annular gap 313 via the inflation passage 24, so that the main chamber 11 and the operating chamber 12 cannot fluidly communicate with each other via the first passage 21 since the first and second annular gaps 313, 314 are not in fluid communication with each other (i.e., the fluid communication between the main chamber 11 and the operating chamber 12 is blocked).

The conditioning resilient member 32 is disposed in the first passage 21, and resiliently biases the conditioning valve 31 toward the ultimate position.

The throttle valve unit 4 is disposed in the casing 10, and is connected between the second end opening 27 and the one of the main chamber 11 and the operating chamber 12 for adjusting the flow rate of the air flowing into the second passage 22 via the second end opening 27 from the one of the main chamber 11 and the operating chamber 12.

The switch valve assembly 5 includes a switch valve 51 and a switch resilient member 52.

The switch valve 51 includes a rod body 511, and two switch sealing rings 512 that are sleeved on the rod body 511 and that are spaced apart from each other. Each of the switch sealing rings 512 is operable to be in air-tight contact with a respective one of first and second additional inner surrounding surfaces of the casing seat 20 that respectively define the first and second shrunk sections 204, 205 of the second passage 22. The switch sealing rings 512 cooperatively define a switch annular gap 513 therebetween. A distance between the switch sealing rings 512 is different from that between the first and second shrunk sections 204, 205 of the second passage 22. The switch valve 51 is movable relative to the casing seat 20 between a non-activated position (see FIGS. 1 to 3) where the trigger assembly 15 is not depressed, and an activated position (see FIGS. 4 to 6) where the trigger assembly 15 is depressed.

When the switch valve 51 is at the non-activated position, one of the switch sealing rings 512 is in air-tight contact with the second additional inner surrounding surface of the casing seat 20 that defines the second shrunk section 205, and the other one of the switch sealing rings 512 is separated from the first additional inner surrounding surface of the casing seat 20 that defines the first shrunk section 204, so that the connecting passage 23 is in fluid communication with the outside via the intermediate section of the second passage 22 (the switch annular gap 513 is in fluid communication with the outside), and is not in fluid communication with the one of the main chamber 11 and the operating chamber 12 that is in fluid communication with the throttle valve unit 4.

When the switch valve 51 is at the activated position upon the depression of the trigger assembly 15 (see FIG. 4), the one of the switch sealing rings 512 is separated from the second additional inner surrounding surface of the casing seat 20 that defines the second shrunk section 205, and the other one of the switch sealing rings 512 is in air-tight contact with the first additional inner surrounding surface of the casing seat 20 that defines the first shrunk section 204, so that the connecting passage 23 is not in fluid communication with the outside (the switch annular gap 513 is not in fluid communication with the outside), and is in fluid communication with the one of the main chamber 11 and the operating chamber 12 via the throttle valve unit 4.

The switch resilient member 52 is disposed in the second passage 22, and resiliently biases the switch valve 51 toward the non-activated position.

Referring to FIGS. 1 to 3, when the trigger assembly 15 is not depressed, the switch valve 51 is at the non-activated position, so that the connecting passage 23 is in fluid communication with the outside via the intermediate section of the second passage 22, and is not in fluid communication with the one of the main chamber 11 and the operating chamber 12 via the throttle valve unit 4. At this time, the pressure in the main chamber 11 acts on the end surface 3111 of the conditioning valve 31 via the first end opening 202 to generate a first resultant force to move the conditioning valve 31 to the initial position against the biasing action of the conditioning resilient member 32 since the pressure in the connecting passage 23 is relatively low (substantially equal to the outside), and the fluid communication between the main chamber 11 and the operating chamber 12 via the first passage 21 and the inflation passage 24 is therefore prevented.

As explained in the previous paragraphs, a fastener can be fired by the pneumatic tool 1 by continuously depressing the trigger assembly 15 and subsequently depressing the safety member 14 to activate the valve rod 161 of the actuating valve 16.

Figure 4:
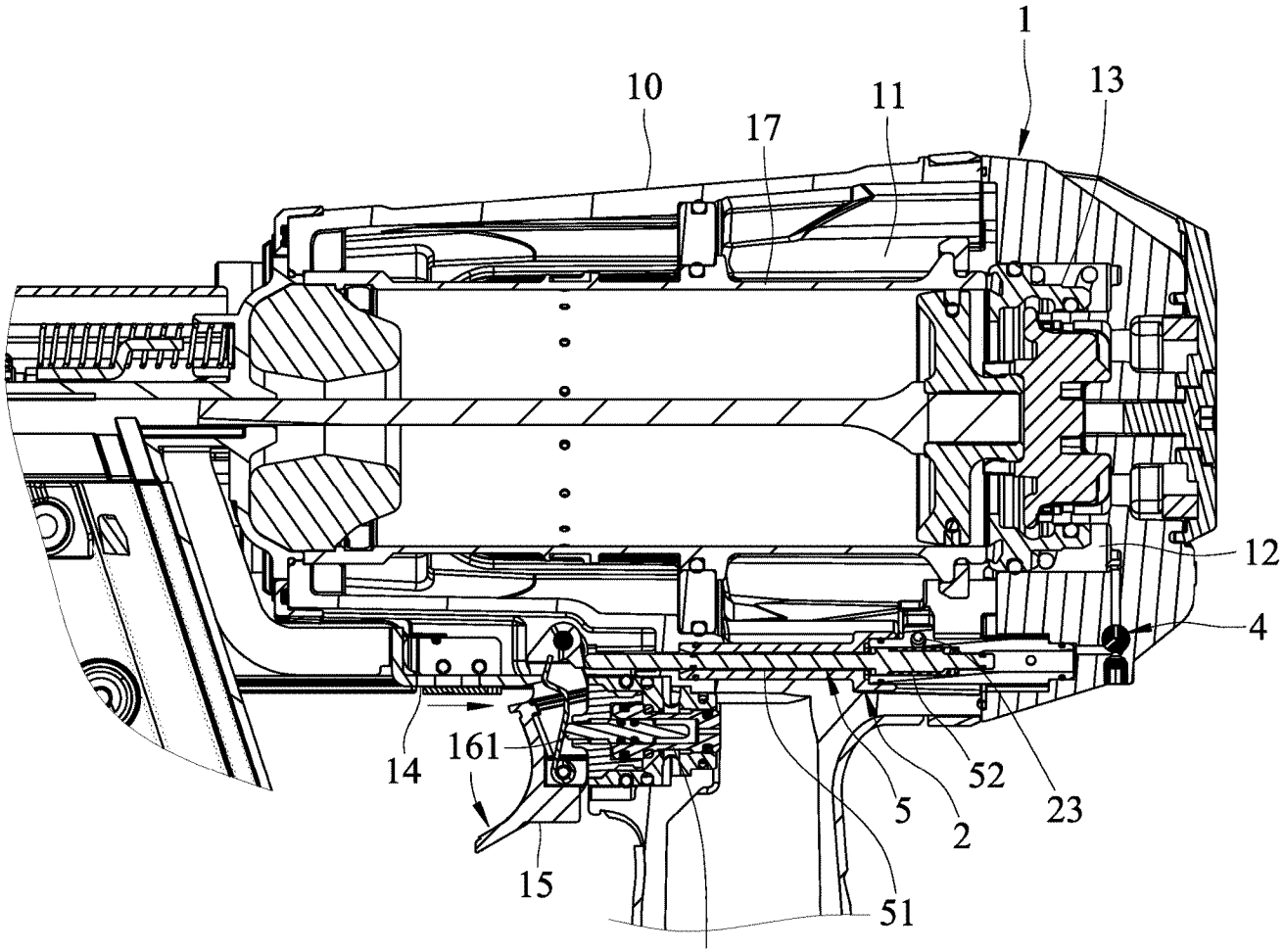
FIG. 4 is a schematic fragmentary sectional view illustrating the switch valve at an activated position.
Figure 5:
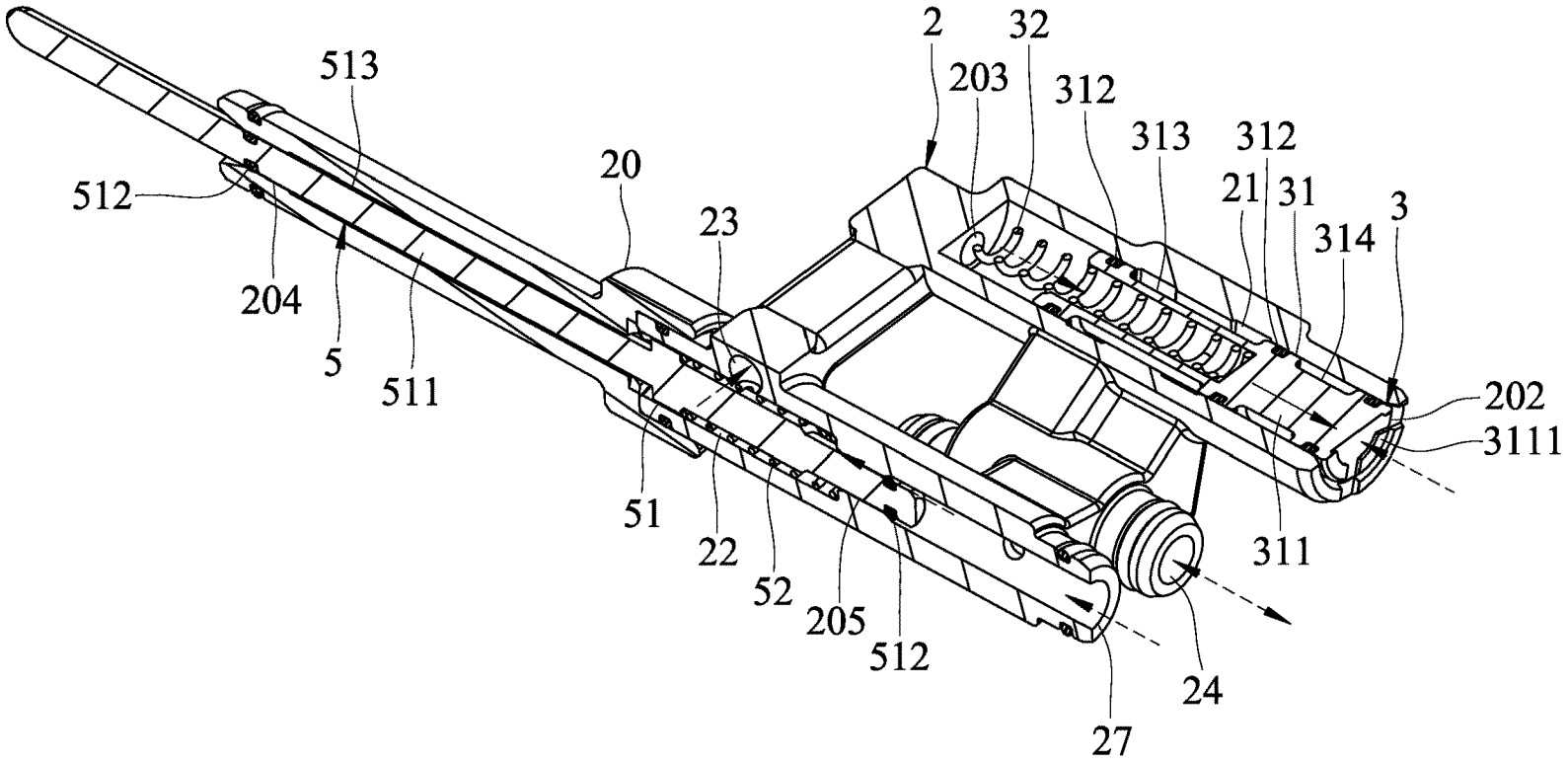
FIG. 5 is still another schematic cutaway perspective view illustrating the conditioning valve at an ultimate position and the switch valve at the activated position.
Figure 6:
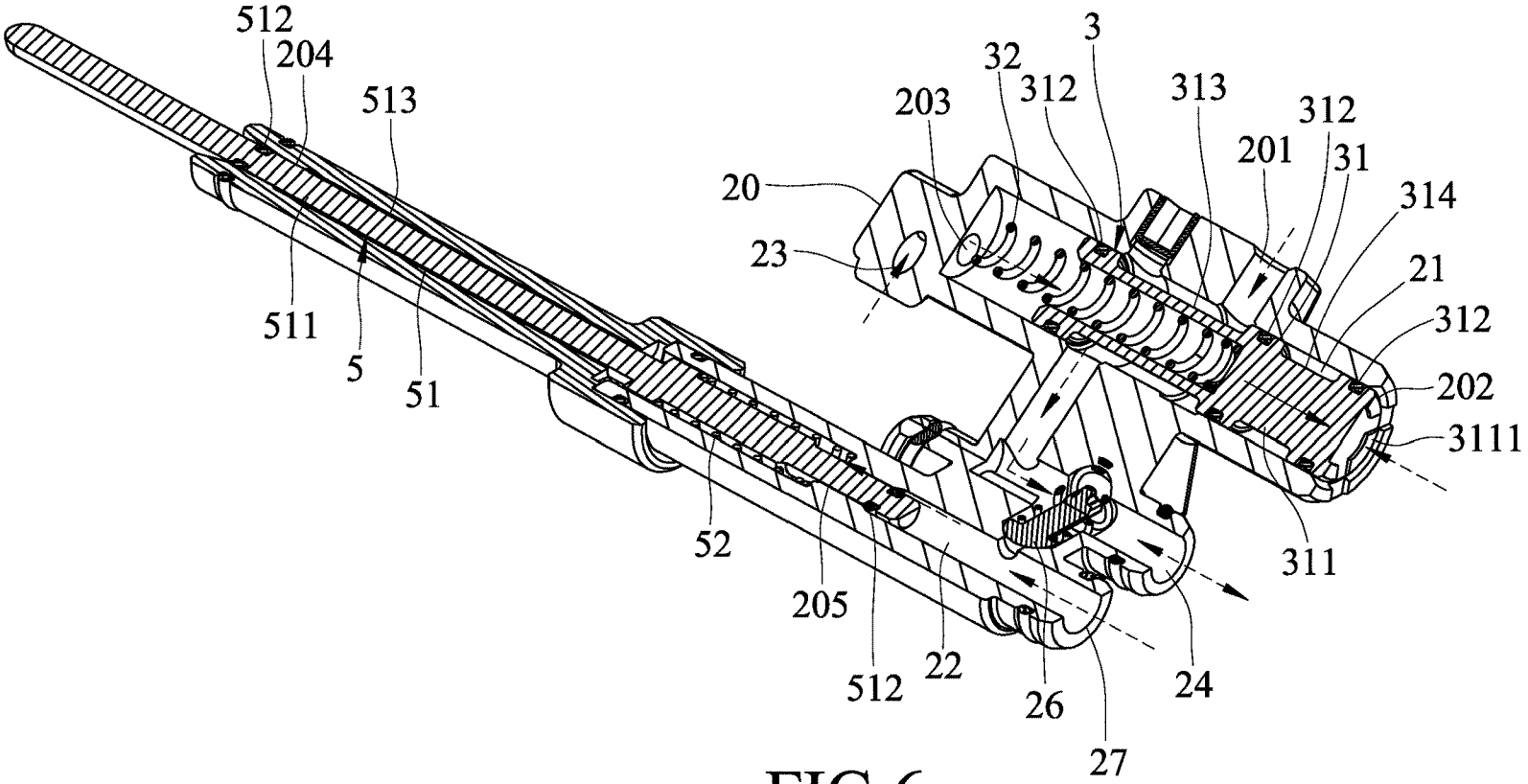
FIG. 6 is still another schematic cutaway perspective view illustrating the conditioning valve at the ultimate position and the switch valve at the activated position.

Referring to FIGS. 4 to 6, when the trigger assembly 15 is continuously depressed without depression of the safety member 14, the switch valve 51 is moved to the activated position, so that the connecting passage 23 is not in fluid communication with the outside, and is in fluid communication with the one of the main chamber and the operating chamber 12 that is in fluid communication with the throttle valve unit 4. At this time, since the valve rod 161 is at the non-activated position (the safety member 14 is not depressed), the pressure in the operating chamber 12 is the same as that in the main chamber 11. As such, the pressure in the one of the main chamber 11 and the operating chamber 12 acts on one side of the conditioning valve 31 opposite to the end surface 3111 via the throttle valve unit 4, the second passage 22 and the connecting passage 23 to generate a second resultant force that has a direction which is substantially opposite to the first resultant force generated by the pressure in the main chamber 11. The sum of the second resultant force and the biasing force generated by the conditioning resilient member 32 is greater than the first resultant force, so that the conditioning valve 31 is moved toward the ultimate position upon continuous depression of the trigger assembly 15.

After the trigger assembly 15 is continuously depressed by a predetermined time period. e.g., (3 to 5 seconds) without depression of the safety member 14 (i.e., the switch valve 51 is continuously activated by the predetermined time period), the conditioning valve 31 is moved by the second resultant force and the biasing force generated by the conditioning resilient member 32 to the ultimate position so as to permit the fluid communication between the main chamber 11 and the operating chamber 12 via the first passage 21 and the inflation passage 24. It should be noted that the predetermined time period is adjustable by virtue of the throttle valve unit 4.

Figure 7:
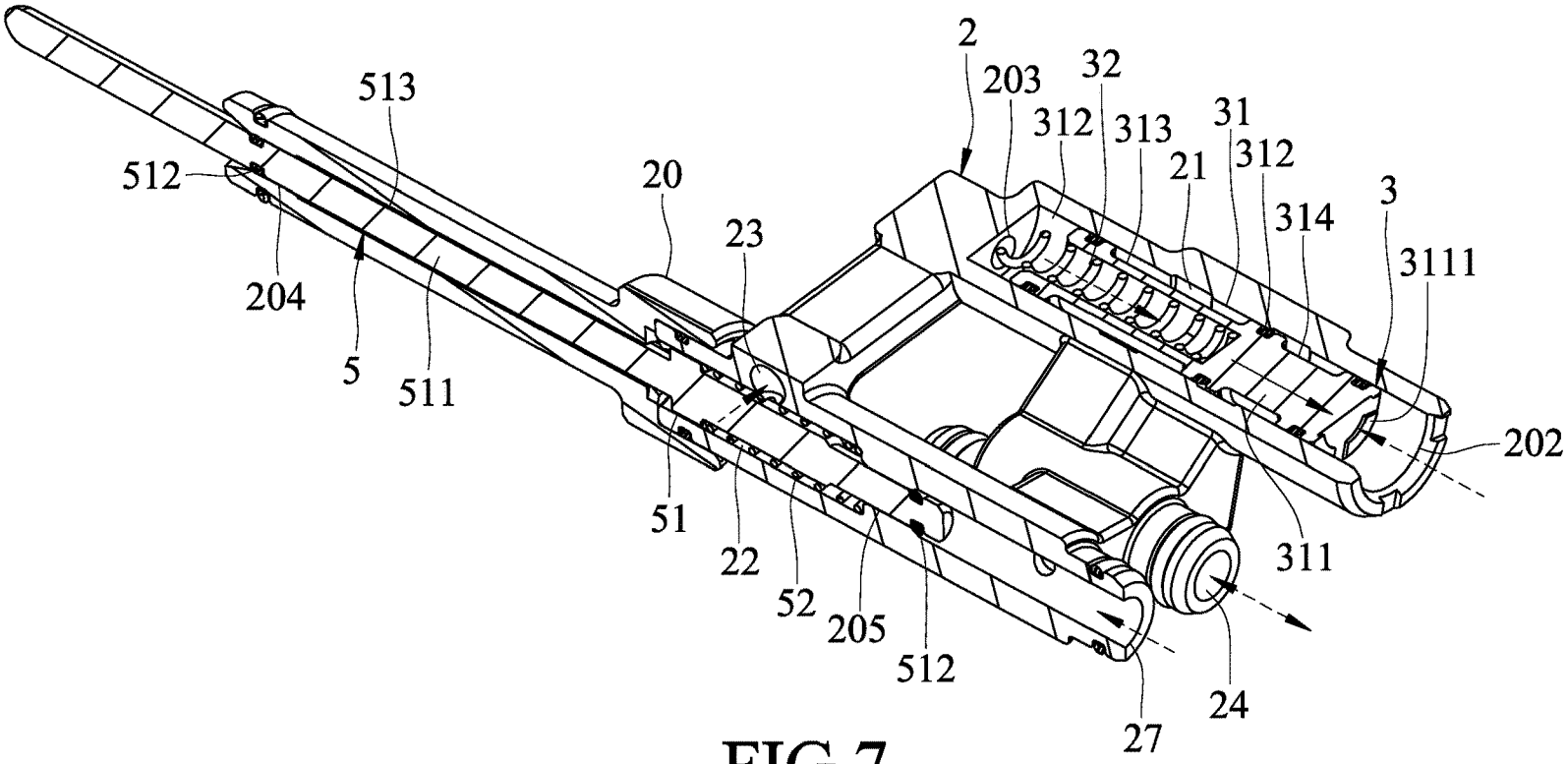
FIG. 7 is still another schematic cutaway perspective view illustrating the conditioning valve being moved away from the initial position and the switch valve at the activated position.
Figure 8:
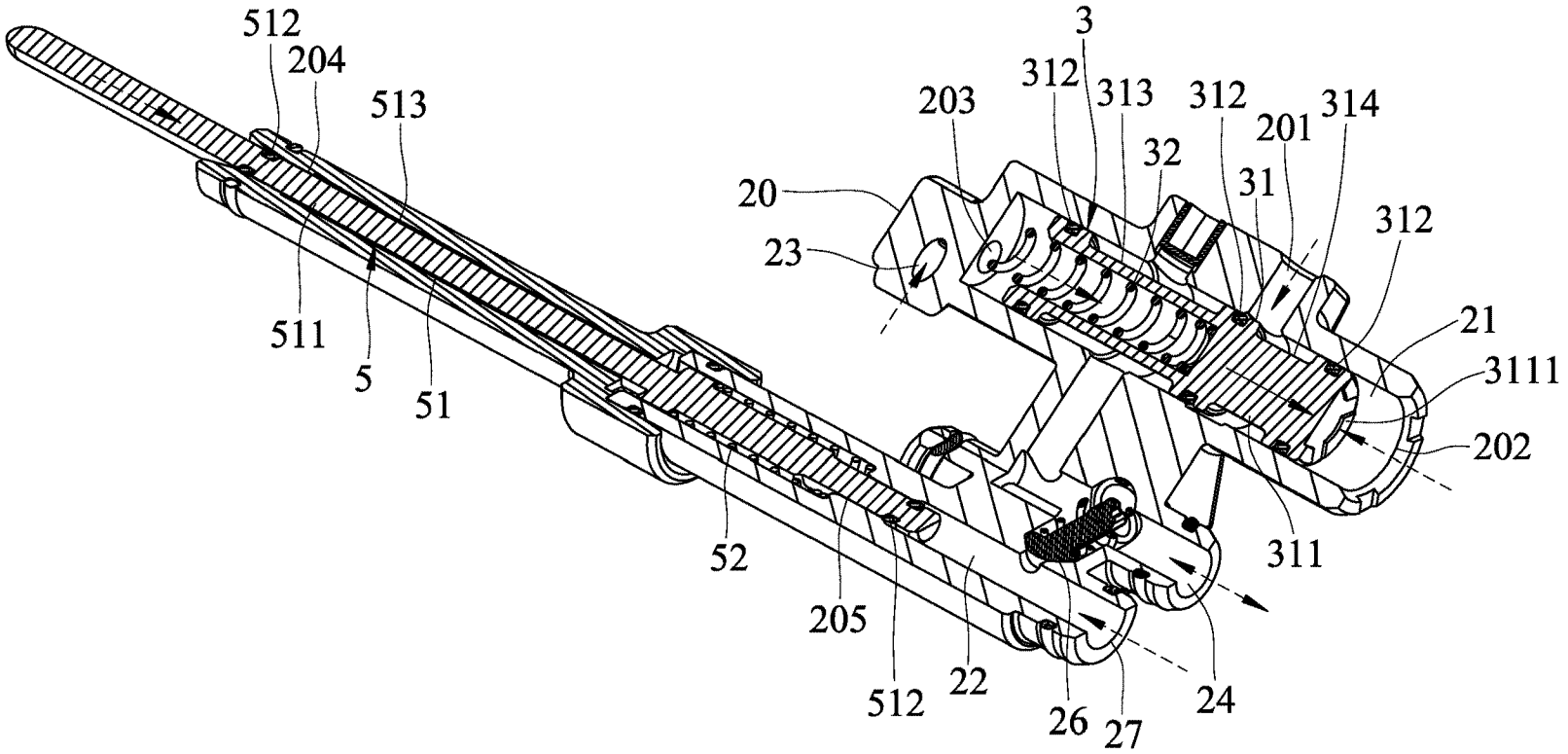
FIG. 8 is still another schematic cutaway perspective view illustrating the conditioning valve being moved away from the initial position and the switch valve at the activated position.

Referring to FIGS. 7 and 8, for firing the fastener, when a time delay between the depression of the trigger assembly 15 and the depression of the safety member 14 is less than the predetermined time period, the valve rod 161 is activated upon the depression of the safety member 14 before the conditioning valve 31 is moved to the ultimate position. Therefore, the fluid communication between the main chamber 11 and the operating chamber 12 via the first passage 21 and the inflation passage 24 is prevented, and the valve head 13 is therefore moved to open the cylinder body 17 due to the pressure difference between the main chamber 11 and the operating chamber 12 (the operating chamber 12 is in fluid communication with the outside when the valve rod 161 is activated), so as to permit the compressed air in the main chamber 11 to flow into the cylinder body 17 for firing the fastener.

Figure 10:
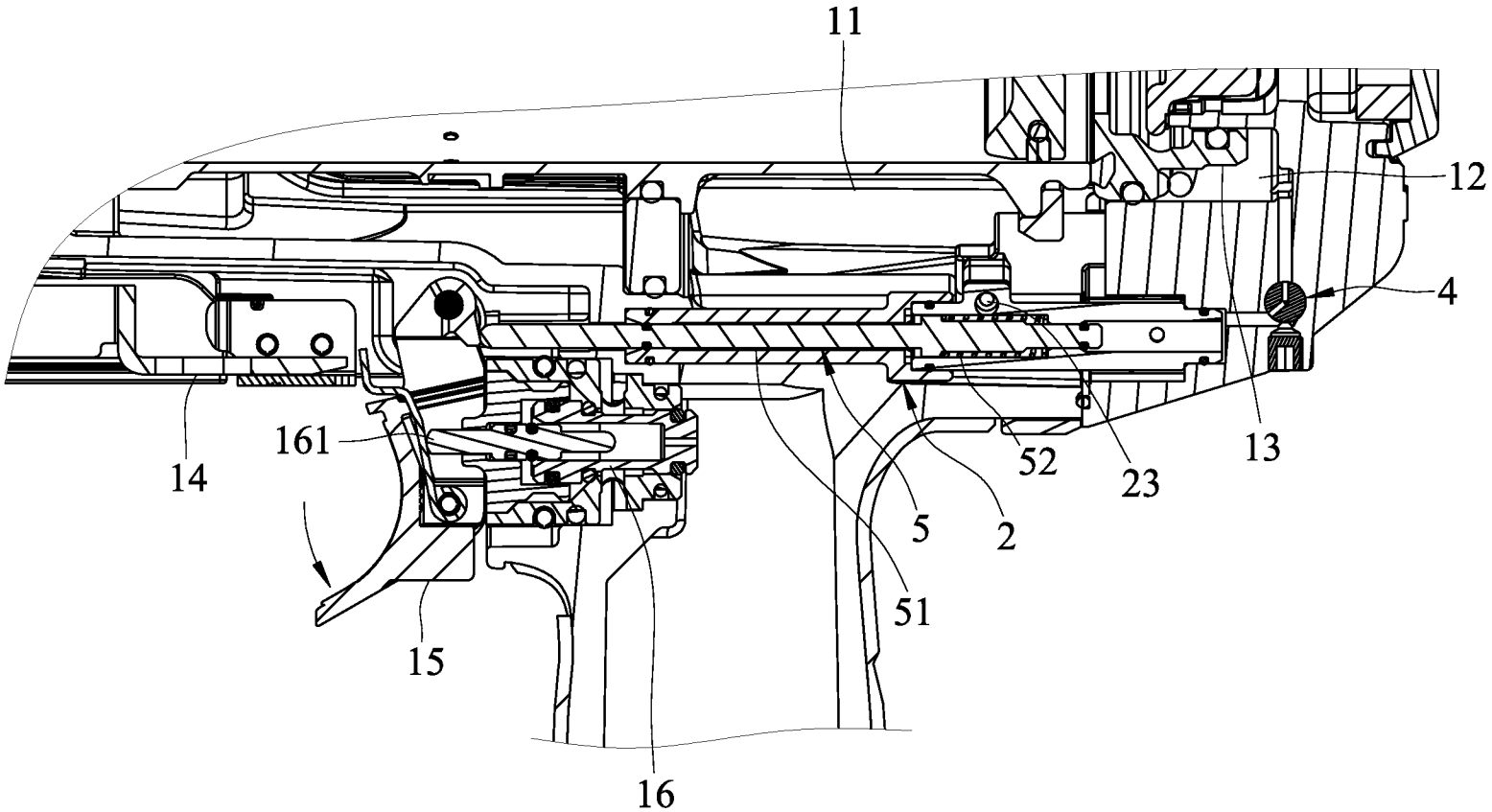
FIG. 10 is another schematic fragmentary sectional view illustrating the switch valve at the activated position.

After the fastener is fired, since the pressure in the operating chamber 12 (substantially equal to the outside) is much smaller than that in the main chamber 11, the first resultant force generated by the pressure in the main chamber 11 moves the conditioning valve 31 back to the initial position against the biasing action of the conditioning resilient member 32.Therefore, with the trigger assembly 15 being continuously depressed (see FIG. 10), the safety member 14 can be depressed again to fire another fastener when the time delay between two successive depressions of the safety member 14 is less than the predetermined time period.

Figure 9:
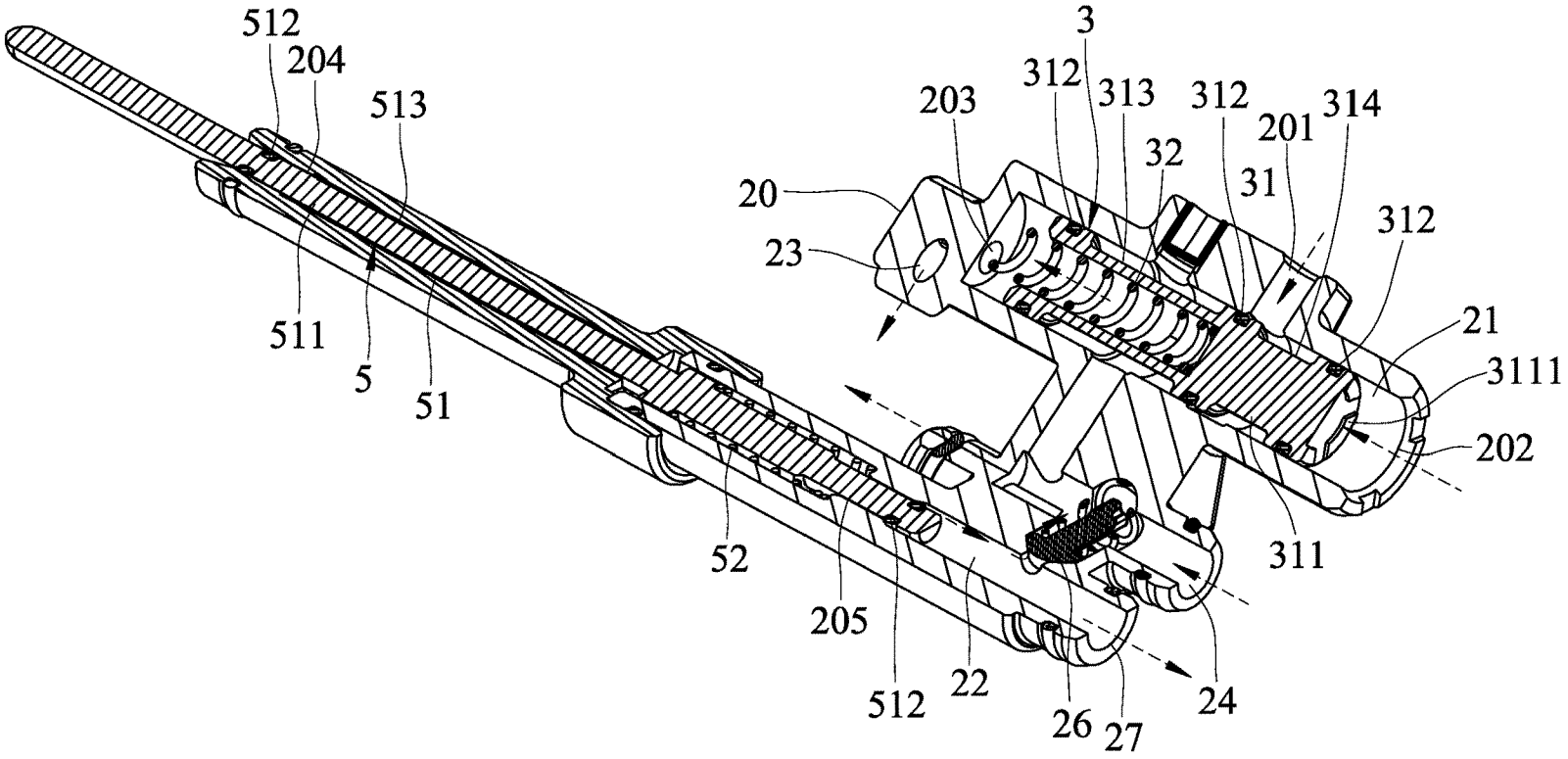
FIG. 9 is still another schematic cutaway perspective view illustrating the conditioning valve being moved away from the ultimate position and the switch valve at the activated position.

Referring to FIG. 9, it should be noted that, during the movement of the conditioning valve 31 back to the initial position, the air in the second lengthwise end section of the first passage 21 is forced by the first resultant force generated by the pressure in the main chamber 11 to flow into the operating chamber 12 to be expelled to the outside via the inner flow path in the casing 10. Under the circumstances that the throttle valve unit 4 communicates fluidly the second end opening 27 with the operating chamber 12, the air in the second lengthwise end section of the first passage 21 is forced to flow into the second passage 22 via the communicating hole 203 and the connecting passage 23, and then to flow into the operating chamber 12 via the throttle valve unit 4 and via the one-way valve unit 26 and the inflation passage 24. Under the circumstances that the throttle valve unit 4 communicates fluidly the second end opening 27 with the main chamber 11, the air in the second lengthwise end section of the first passage 21 is forced to flow into the second passage 22 via the communicating hole 203 and the connecting passage 23, and then to flow into the operating chamber 12 via the one-way valve unit 26 and the inflation passage 24.

On the contrary, for firing the fastener, when a time delay between the depression of the trigger assembly 15 and the depression of the safety member 14 is greater than the predetermined time period, the conditioning valve 31 is moved to the ultimate position to permit the fluid communication between the main chamber 11 and the operating chamber 12 via the first passage 21 and the inflation passage 24 before the valve rod 161 is activated. Therefore, when the valve rod 161 is activated upon the depression of the safety member 14 to permit the fluid communication between the operating chamber 12 and the outside for firing the fastener, the pressure difference between the main chamber 11 and the operating chamber 12 is insufficient to move the valve head 13 to open the cylinder body 17 since the compressed air in the main chamber 11 continuously flows into the operating chamber 12 via the first passage 21 and the inflation passage 24, and the firing of the fastener is therefore prevented.

The trigger assembly 15 can be released such that the switch valve 51 is moved back to non-activated position by the switch resilient member 52 to permit the fluid communication between the connecting passage 23 and the outside via the intermediate section of the second passage 22, and to prevent the fluid communication between the connecting passage 23 and the one of the main chamber 11 and the operating chamber 12 via the throttle valve unit 4, and that the conditioning valve 31 is therefore moved back to the initial position by the first resultant force generated by the pressure in the main chamber 11 against the biasing action of the conditioning resilient member 32.

Figure 11:
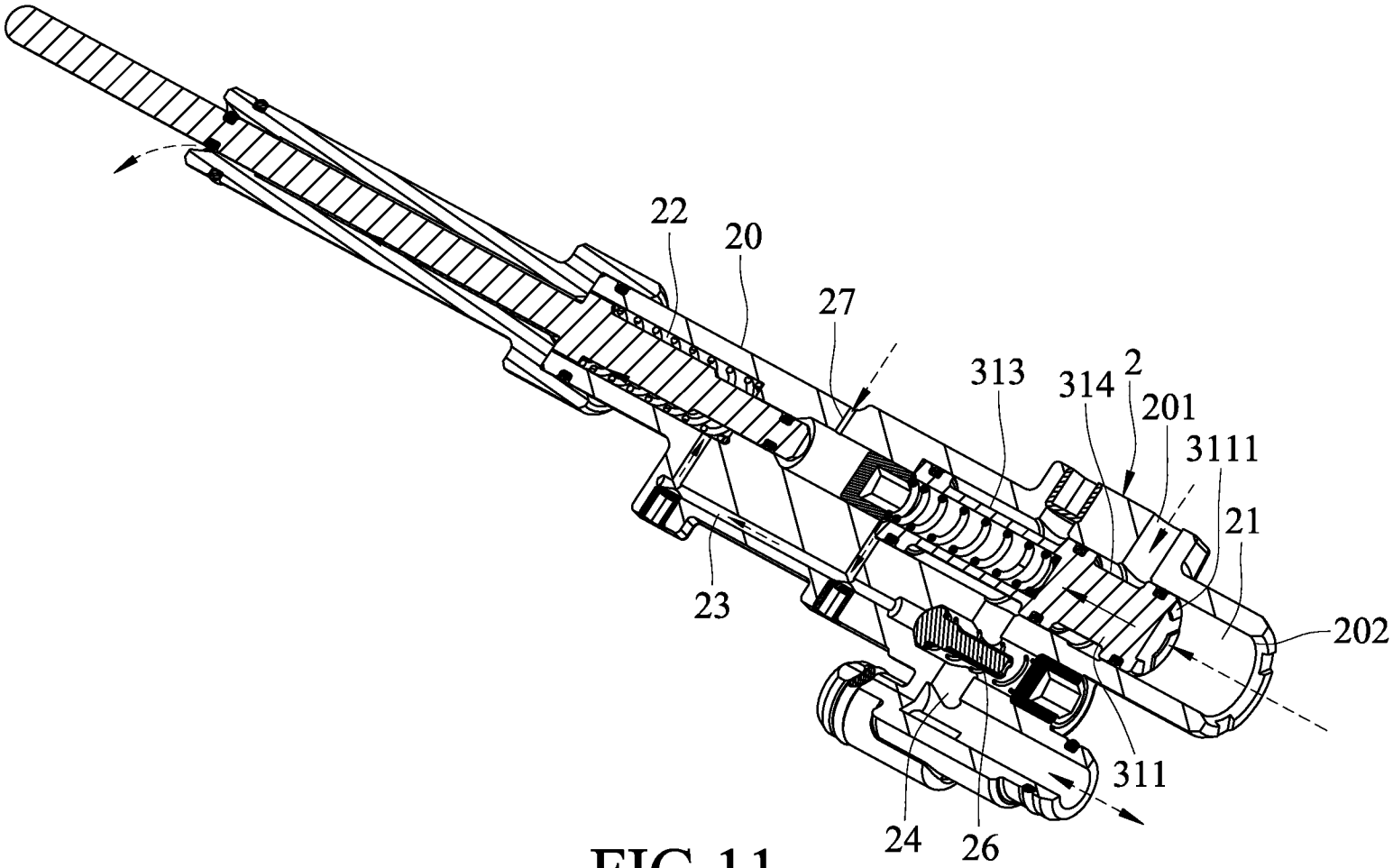
FIG. 11 is a schematic cutaway perspective view illustrating a second embodiment of the firing control device according to the disclosure, a conditioning valve of the second embodiment being at an initial position, a switch valve of the second embodiment being at a non-activated position.
Figure 12:
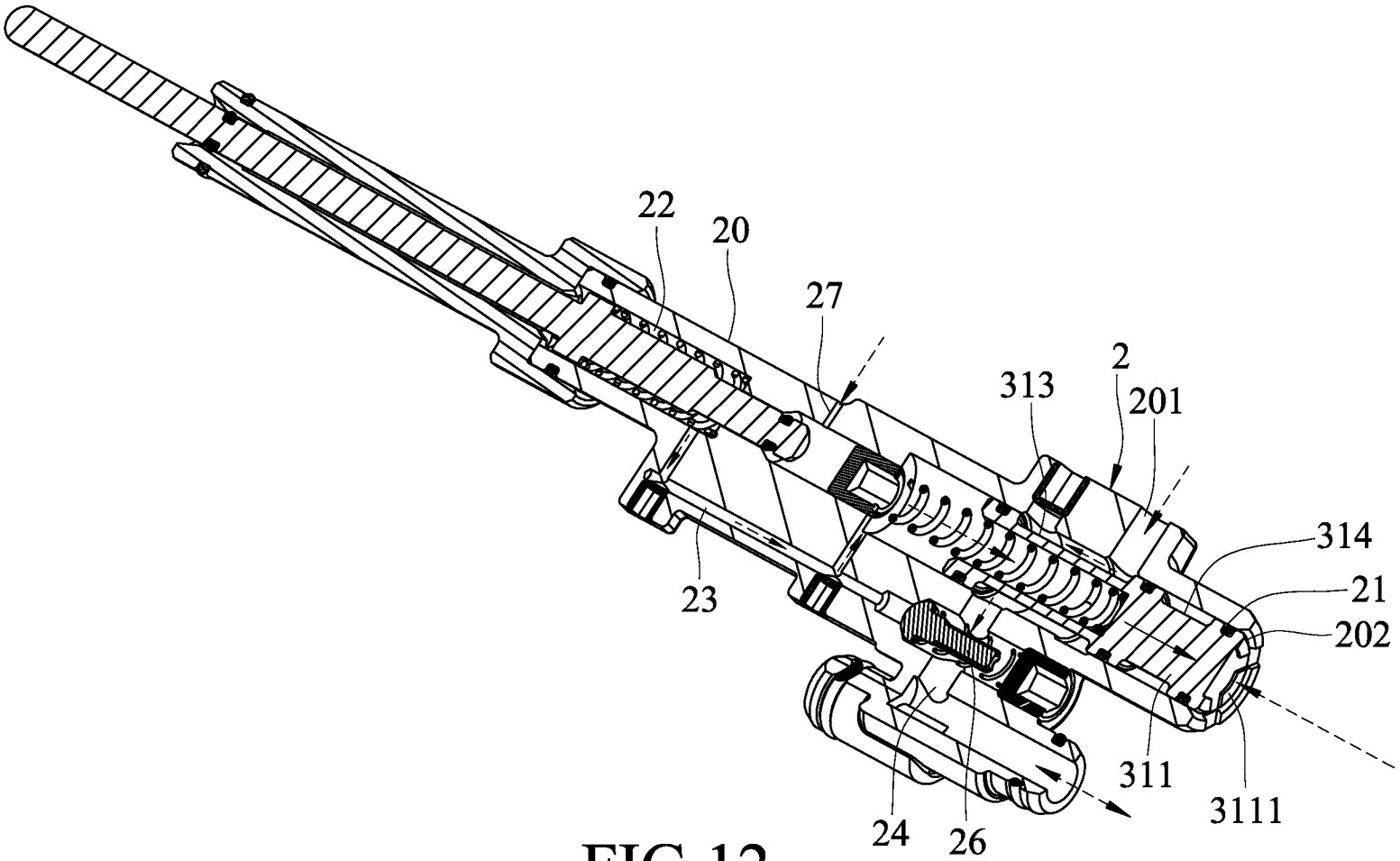
FIG. 12 is another schematic cutaway perspective view illustrating the conditioning valve at an ultimate position and the switch valve at an activated position.
Figure 13:
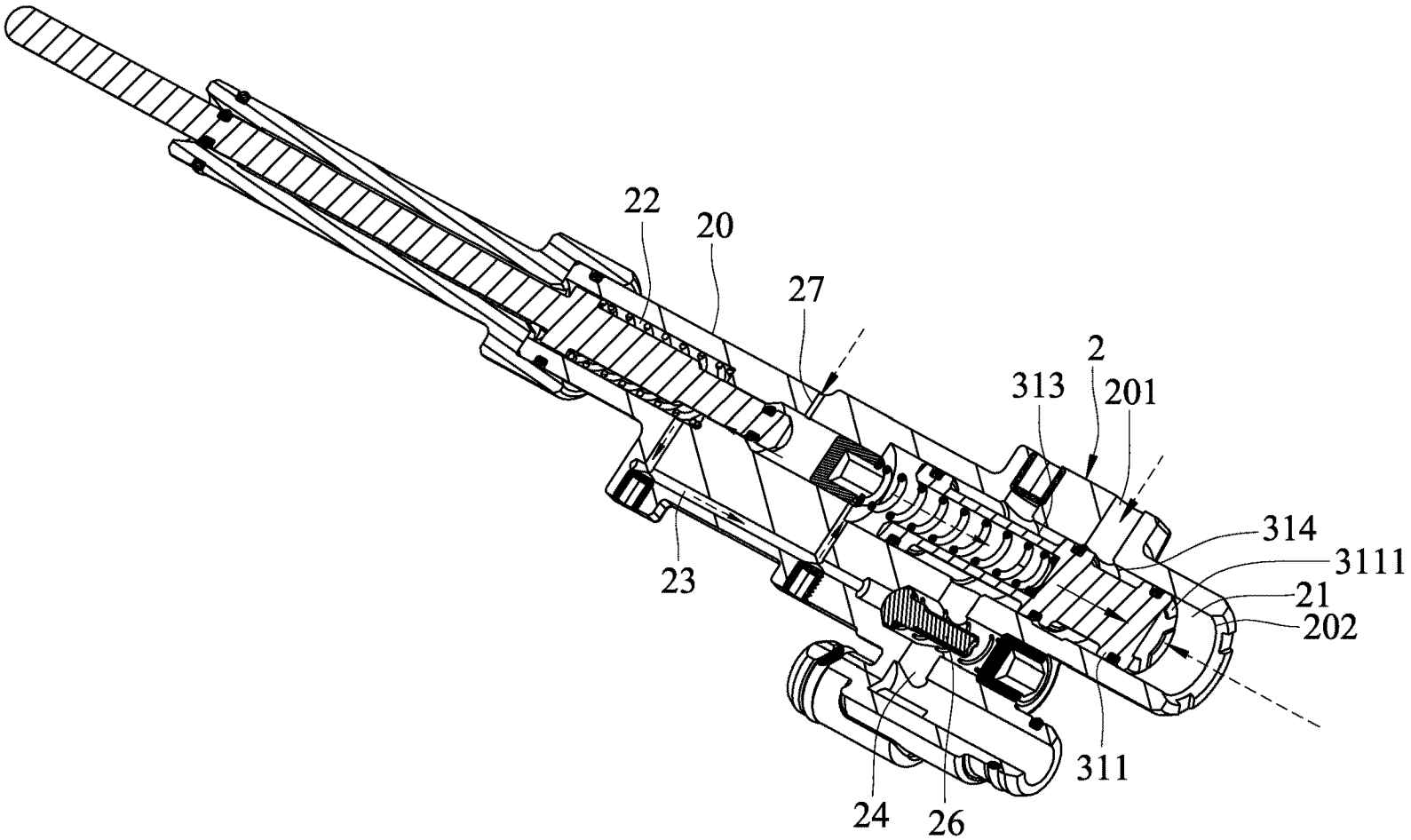
FIG. 13 is still another schematic cutaway perspective view illustrating the conditioning valve being moved away from the initial position and the switch valve at the activated position.

Referring to FIGS. 11 to 13, the second embodiment of the firing control device according to the disclosure is similar to the first embodiment. The differences between the first and second embodiments reside in that the first and second passages 21, 22 of the second embodiment are aligned with each other, the connecting passage 23 of the second embodiment is U-shaped, and the one-way valve unit 26 of the second embodiment is capable of fluidly communicating the connecting passage 23 with the inflation passage 24 and permits the air to flow from the connecting passage 23 into the inflation passage 24 only. In other words, a distance between the one-way valve unit 26 and the second lengthwise end section of the first passage 21 is smaller than that of the first embodiment The throttle valve unit (not shown) of the second embodiment is connected between the second end opening 27 and the one of the main chamber 11 and the operating chamber 12 (referring to FIG. 1) for adjusting the flow rate of the air flowing into the second passage 22 via the second end opening 27 from the one of the main chamber 11 and the operating chamber 12.

Figure 14:
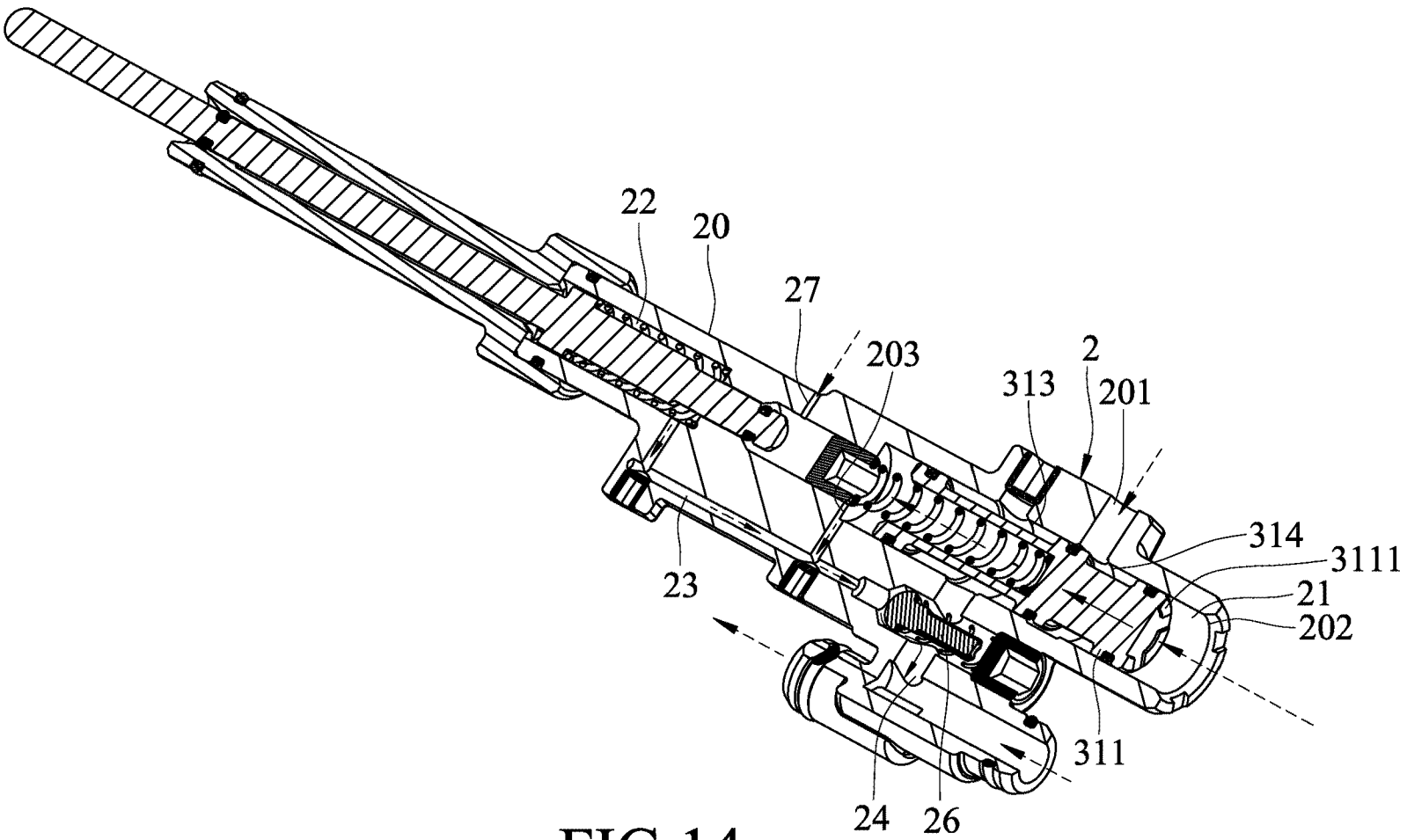
FIG. 14 is still another schematic cutaway perspective view illustrating the conditioning valve being moved away from the ultimate position and the switch valve at the activated position.

The operation of the second embodiment is similar to that of the first embodiment. Referring to FIG. 14, it should be noted that under the circumstances that the throttle valve unit of the second embodiment communicates fluidly the second end opening 27 with the main chamber 11 (referring to FIG. 1), during the movement of the conditioning valve 31 back to the initial position after the fastener is fired, the air in the second lengthwise end section of the first passage 21 is forced to flow into the connecting passage 23 via the communicating hole 203, and then to flow into the operating chamber 12 via the one-way valve unit 26 and the inflation passage 24. Under the circumstances that the throttle valve unit of the second embodiment communicates fluidly the second end opening 27 with the operating chamber 12 (referring to FIG. 1), during the movement of the conditioning valve 31 back to the initial position after the fastener is fired, the air in the second lengthwise end section of the first passage 21 is forced to flow into the connecting passage 23 via the communicating hole 203, and then to flow into the operating chamber 12 via the one-way valve unit 26 and the inflation passage 24, and via the second passage 12 and the throttle valve unit.

The advantages of this disclosure are as follows:

1. The conditioning valve 31 serves to control the communication between the main chamber 11 and the operating chamber 12 via the first passage 21 and the inflation passage 24, and is not in contact with a moving element, so that the conditioning valve 31 may not easily be worn.

2. Since the conditioning valve 31 is not in contact with a moving element, the air-tightness between the conditioning valve 31 and the inner surrounding surface of the casing seat 20 that defines the first passage 21 would not be affected and can be maintained.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment, " "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A firing control device adapted for use in a pneumatic tool, the pneumatic tool including a casing that defines a main chamber and an operating chamber therein, a safety member that is movably mounted to the casing, a trigger assembly that is pivotally mounted to the casing, and a valve rod that is movable relative to the casing, when both of the safety member and the trigger assembly are depressed, the valve rod being activated for preventing fluid communication between the main chamber and the operating chamber and for releasing the pressure in the operating chamber so as to fire a fastener, said firing control device comprising:

a flow path unit adapted to be connected to the main chamber, the operating chamber and the outside of the pneumatic tool;

a conditioning valve assembly including a conditioning valve that is movably disposed in said flow path unit and that removably blocks fluid communication between the main chamber and the operating chamber via said flow path unit; and a switch valve assembly including a switch valve that is movably disposed in said flow path unit, said switch valve being activated upon the depression of the trigger assembly to prevent fluid communication between said flow path unit and the outside, and to permit the pressure in the casing to move said conditioning valve, said conditioning valve being moved to permit the fluid communication between the main chamber and the operating chamber via said flow path unit when said switch valve is continuously activated by a predetermined time period, so that the fluid communication between the main chamber and the operating chamber is maintained upon the activation of the valve rod, and the fastener is prevented from being fired.

2. The firing control device as claimed in claim 1, wherein said flow path unit includes a first passage that is adapted to be in fluid communication with the main chamber and that receives said conditioning valve therein, a second passage that is connected to said first passage and the outside and that receives said switch valve therein, and an inflation passage that is in fluid communication with said first passage and the operating chamber and that is for guiding an air flow from the main chamber to the operating chamber via said first passage.

3. The firing control device as claimed in claim 2, wherein said flow path unit further includes a connecting passage that is in fluid communication with said first and second passages, and a second end opening via which said second passage is adapted to be in fluid communication with the operating chamber, when said switch valve is activated, the pressure in the operating chamber acting on said conditioning valve via said second end opening, said second passage and said connecting passage, so as to move said conditioning valve to permit the fluid communication between the main chamber and the operating chamber via said first passage and said inflation passage.

4. The firing control device as claimed in claim 3, wherein said switch valve assembly further includes a switch resilient member, said switch valve being movable relative to said flow path unit between a non-activated position and an activated position, when said switch valve is at the non-activated position, said connecting passage being in fluid communication with the outside said second passage, and being riot in fluid communication with the operating chamber, when said switch valve is at the activated position, said connecting passage being not in fluid communication with the outside, and being in fluid communication with the operating chamber via said second end opening and said second passage, said switch resilient member being disposed in said second passage, and resiliently biasing said switch valve toward the non-activated position.

5. The firing control device as claimed in claim 4, wherein said switch valve includes a rod body, and two switch sealing rings that are sleeved on said rod body and that cooperatively define a switch annular gap therebetween, said switch annular gap being in fluid communication with said connecting passage, when said switch valve is at the non-activated position, said switch annular gap being in fluid communication with the outside, and one of said switch sealing rings sealing said second passage to prevent the fluid communication between said switch annular gap and the operating chamber, when said switch valve is at the activated position, said switch annular gap being in fluid communication with the operating chamber, and the other one of said switch sealing rings sealing said second passage to prevent the fluid communication between said switch annular gap and the outside.

6. The firing control device as claimed in claim 3, further comprising a throttle valve unit that is adapted to be disposed in the casing, and that is connected between said second end opening and the operating chamber for adjusting the flow rate of the air flowing from the operating chamber into said second passage via said second end opening.

7. The firing control device as claimed in claim 3, wherein said conditioning valve assembly further includes a conditioning resilient member, said conditioning valve being movable relative to said flow path unit between an initial position and an ultimate position, the fluid communication between the main chamber and the operating chamber via said first passage and said inflation passage being permitted when said conditioning valve is at the ultimate position, the fluid communication between the main chamber and the operating chamber via said first passage and said inflation passage being prevented when said conditioning valve is away from the ultimate position, said conditioning resilient member being disposed in said first passage, and resiliently biasing said conditioning valve toward the ultimate position.

8. The firing control device as claimed in claim 7, wherein said conditioning valve includes a valve body, and three conditioning sealing rings that are sleeved on said valve body and that are spaced apart from each other, said conditioning sealing rings cooperatively defining first and second annular gaps that are not in fluid communication with each other, when said conditioning valve is at the ultimate position, the main chamber being in fluid communication with said first annular gap, and the operating chamber being in fluid communication with said first annular gap via said inflation passage so as to be in fluid communication with the main chamber, when said conditioning valve leaves the ultimate position, the main chamber being in fluid communication with said second annular gap, and the operating chamber being in fluid communication with said first annular gap via said inflation passage so as not to be in fluid communication with the main chamber.

9. The firing control device as claimed in claim 8, wherein said flow path unit further includes a casing seat that s formed with said first passage, said second passage, said connecting passage and said inflation passage, said casing seat having a lateral opening that communicates fluidly the main chamber with an intermediate section of said first passage, a first end opening that communicates fluidly the main chamber with a first lengthwise end section of said first passage, said valve body of said conditioning valve having an end surface that faces toward said first end opening, the pressure in the main chamber acting on said end surface of said conditioning valve via said first end opening.

10. The firing control device as claimed in claim 2, wherein said flow path unit further includes a connecting passage that is in fluid communication with said first and second passages, and a second end opening via which said second passage is adapted to be in fluid communication with the main chamber, when said switch valve is activated, the pressure in the main chamber acting on said conditioning valve via said second end opening, said second passage and said connecting passage, so as to move said conditioning valve to permit the fluid communication between the main chamber and the operating chamber via said first passage and said inflation passage.

11. The firing control device as claimed in claim 10, wherein said switch valve assembly further includes a switch resilient member, said switch valve being movable relative to said flow path unit between a non-activated position and an activated position, when said switch valve is at the non-activated position, said connecting passage being in fluid communication with the outside via said second passage, and being not in fluid communication with the main chamber, when said switch valve is at the activated position, said connecting passage being not in fluid communication with the outside, and being in fluid communication with the main chamber via said second end opening and said second passage, said switch resilient member being disposed in said second passage, and resiliently biasing said switch valve toward the non-activated position.

12. The firing control device as claimed in claim 11, wherein said switch valve includes a rod body, and two switch sealing rings that are sleeved on said rod body and that cooperatively define a switch annular gap therebetween, said switch annular gap being in fluid communication with said connecting passage, when said switch valve is at the non-activated position, said switch annular gap being in fluid communication with the outside, and one of said switch sealing rings sealing said second passage to prevent the fluid communication between said switch annular gap and the main chamber, when said switch valve is at the activated position, said switch annular gap being in fluid communication with the main chamber, and the other one of said switch sealing rings sealing said second passage to prevent the fluid communication between said switch annular gap and the outside.

13. The firing control device as claimed in claim 10, further comprising a throttle valve unit that is adapted to be disposed in toe casing, and that is connected between said second end opening and rue main chamber for adjusting the flow rate of the air flowing from the main chamber into said second passage via said second end opening.

14. The firing control device as claimed in claim 10, wherein said conditioning valve assembly further includes a conditioning resilient member, said conditioning valve being movable relative to said flow path unit between an initial position and an ultimate position, the fluid communication between the main chamber and the operating chamber via said first passage and said inflation passage being prevented when said conditioning valve is at the initial position, the fluid communication between the main chamber and the operating chamber via said first passage and said inflation passage being permitted when said conditioning valve is at the ultimate position, said conditioning resilient member being disposed in said first passage, and resiliently biasing said conditioning valve toward the ultimate position.

15. The firing control device as claimed in claim 14, wherein said conditioning valve includes a valve body, and three conditioning sealing rings that are sleeved on said valve body and that are spaced apart from each other, said conditioning sealing rings cooperatively defining first and second annular gaps that are not in fluid communication with each other, when said conditioning valve is at the ultimate position, the main chamber being in fluid communication with said first annular gap, and the operating chamber being in fluid communication with said first annular gap via said inflation passage so as to be in fluid communication with the main chamber, when said conditioning valve leaves the ultimate position, the main chamber being in fluid communication with said second annular gap, and the operating chamber being in fluid communication with said first annular gap via said inflation passage so as not to be in fluid communication with the main chamber.

16. The firing control device as claimed in claim 15, wherein said flow path unit further includes a casing seat that is formed with said first passage, said second passage, said connecting passage and said inflation passage, said casing seat having a lateral opening that communicates fluidly the main chamber with an intermediate section of said first passage, a first end opening that communicates fluidly the main chamber with a first lengthwise end section of said first passage, said valve body of said conditioning valve having an end surface that faces toward said first end opening, the pressure in the main chamber acting on said end surface of said conditioning valve via said first end opening.

* * * * *